US012593891B2

(12) United States Patent
Bernhard et al.

(10) Patent No.: US 12,593,891 B2
(45) Date of Patent: Apr. 7, 2026

(54) SOLE FOR A RUNNING SHOE

(71) Applicant: ON CLOUDS GMBH, Zürich (CH)

(72) Inventors: Olivier Bernhard, Heiden (CH); Ilmarin Heitz, Zürich (CH); Kevin Dellion, Zürich (CH); Nils Altrogge, Zumikon (CH); Oliver Hirvonen, Zürich (CH)

(73) Assignee: ON CLOUDS GMBH, Zurich (CH)

( * ) Notice: Subject to any disclaimer, the term of this patent is extended or adjusted under 35 U.S.C. 154(b) by 170 days.

(21) Appl. No.: 17/799,192

(22) PCT Filed: Feb. 19, 2021

(86) PCT No.: PCT/EP2021/054105
§ 371 (c)(1),
(2) Date: Jan. 4, 2023

(87) PCT Pub. No.: WO2021/165444
PCT Pub. Date: Aug. 26, 2021

(65) Prior Publication Data

US 2023/0140074 A1 May 4, 2023

(30) Foreign Application Priority Data

Feb. 20, 2020 (CH) ..... 00196/20

(51) Int. Cl.
*A43B 13/18* (2006.01)
*A43B 13/12* (2006.01)
*A43B 13/14* (2006.01)

(52) U.S. Cl.
CPC ..... *A43B 13/187* (2013.01); *A43B 13/127* (2013.01); *A43B 13/145* (2013.01)

(58) Field of Classification Search
CPC ..... A43B 13/12; A43B 13/125; A43B 13/127; A43B 13/141; A43B 13/187; A43B 13/206; A43B 13/42
See application file for complete search history.

(56) References Cited

U.S. PATENT DOCUMENTS 2,364,134 A * 12/1944 Dow ..... A43B 13/04 428/95
4,235,026 A * 11/1980 Plagenhoef ..... A43B 13/181 36/28

(Continued)

FOREIGN PATENT DOCUMENTS

WO WO 2014/208962 A1 12/2014
WO WO 2016/184920 A1 11/2016

OTHER PUBLICATIONS

EPO (Riswijk, NL), English language version of the International Search Report, Form PCT/ISA/210, for International Application PCT/EP2021/054105, May 17, 2021 (2 pages).

*Primary Examiner* — Heather Mangine
(74) *Attorney, Agent, or Firm* — Pauley Erickson & Swanson

(57) ABSTRACT

A sole for a running shoe having a midsole (1), the midsole (1) having a soft-elastic top layer (2) and a soft-elastic bottom layer (3), a flexurally elastic incompressible plate (4) being arranged in the vertical direction (V) between the top layer (2) and the bottom layer (3), and the bottom layer (3) having a plurality of channels (31*a*, 31*a*, 31*b*, 31*c*) extending in the transverse direction (Q), the channels (31*a*, 31*b*, 31*c*) of the bottom layer (3) being deformable vertically (V) and/or horizontally in the longitudinal direction (L) under the action of forces acting vertically (V) and/or in the longitudinal direction (L) and occurring during running.

16 Claims, 2 Drawing Sheets

(56) References Cited

U.S. PATENT DOCUMENTS 4,359,830 A * 11/1982 Inohara ..... A43B 13/206 36/35 B
4,364,189 A * 12/1982 Bates ..... A43B 13/12 36/31
4,438,573 A * 3/1984 McBarron ..... A43B 13/181 36/29
4,506,461 A * 3/1985 Inohara ..... A43B 13/20 36/35 B
4,561,195 A * 12/1985 Onoda ..... A43B 13/12 36/31
6,065,230 A * 5/2000 James ..... A43B 13/187 36/25 R
6,205,681 B1 * 3/2001 Kita ..... A43B 13/026 36/27
6,289,608 B1 * 9/2001 Kita ..... A43B 13/181 36/28
6,295,741 B1 * 10/2001 Kita ..... A43B 13/12 36/31
6,389,713 B1 * 5/2002 Kita ..... A43B 13/18 36/31
6,625,905 B2 * 9/2003 Kita ..... A43B 13/12 36/28
8,707,587 B2 * 4/2014 Christensen ..... A43B 13/181 36/31
D722,426 S * 2/2015 Davis ..... D2/947
D804,159 S * 12/2017 Allemann ..... D2/947
D813,503 S * 3/2018 Brunner ..... D2/908
D895,951 S * 9/2020 Hardigan ..... D2/947
D896,484 S * 9/2020 Hardigan ..... D2/947
D900,462 S * 11/2020 Brunner ..... D2/972
D903,254 S * 12/2020 Simone ..... D2/947
D989,467 S * 6/2023 Rüegg ..... D2/947
D990,121 S * 6/2023 Simone ..... D2/947
D1,004,258 S * 11/2023 Schloegel ..... D2/947
2004/0154189 A1 * 8/2004 Wang ..... A43B 13/12 36/28
2004/0194343 A1 * 10/2004 Kim ..... A43B 13/141 36/28
2006/0137227 A1 * 6/2006 Kita ..... A43B 13/181 36/102
2006/0265902 A1 * 11/2006 Kita ..... A43B 13/183 36/12
2007/0220778 A1 * 9/2007 Fusco ..... A43B 13/186 36/28
2008/0052965 A1 * 3/2008 Sato ..... A43B 13/026 36/103
2009/0013558 A1 * 1/2009 Hazenberg ..... A43B 13/18 521/50
2009/0178300 A1 * 7/2009 Parker ..... A43B 13/20 12/146 B
2011/0016746 A1 * 1/2011 Callahan ..... A43B 13/187 36/28
2011/0016749 A1 * 1/2011 Callahan ..... A43B 13/14 12/146 B
2012/0079747 A1 * 4/2012 Seo ..... A43B 13/183 36/25 R
2013/0247425 A1 * 9/2013 Davis ..... A43B 13/026 36/30 R
2014/0015169 A1 * 1/2014 Wan ..... A43B 13/04 12/142 T
2014/0202031 A1 * 7/2014 Seo ..... A43B 13/127 36/28
2015/0173456 A1 * 6/2015 Rushbrook ..... A43B 13/181 36/25 R
2015/0230549 A1 * 8/2015 Bernhard ..... A43B 13/181 36/25 R
2016/0021974 A1 * 1/2016 Schindler ..... A43B 13/223 12/146 B
2018/0092431 A1 * 4/2018 Luchi ..... A43B 13/026
2018/0295934 A1 * 10/2018 Bernhard ..... A43B 13/181
2019/0053571 A1 * 2/2019 Bjornson ..... A43B 13/145
2019/0082781 A1 * 3/2019 Iuchi ..... A43B 13/04
2019/0216169 A1 * 7/2019 Yahata ..... A43B 13/146
2019/0261737 A1 * 8/2019 Walsh ..... A43B 13/18
2019/0281922 A1 * 9/2019 Ito ..... A43B 3/26
2019/0289961 A1 * 9/2019 Iuchi ..... A43B 13/026
2021/0093040 A1 * 4/2021 Yoshida ..... A43B 13/04
2021/0227927 A1 * 7/2021 Nakaya ..... A43B 13/186
2021/0282496 A1 * 9/2021 Mason ..... A43B 13/04
2022/0031018 A1 * 2/2022 Bernhard ..... A43B 13/125
2023/0041399 A1 * 2/2023 Bernhard ..... A43B 13/37
2023/0140074 A1 * 5/2023 Bernhard ..... A43B 13/187 36/28

* cited by examiner

SOLE FOR A RUNNING SHOE

CROSS REFERENCE TO RELATED APPLICATION

This application is a National Phase filing in the United States, under 35 USC § 371, of PCT International Patent Application PCT/EP2021/054105, filed on 21 Jan. 2021 which claims the priority of Swiss Patent Application CH 00196/20, filed 20 Feb. 2020.

These applications are hereby incorporated by reference herein in their entirety and is made a part hereof, including but not limited to those portions which specifically appear hereinafter.

BACKGROUND OF THE INVENTION

Field of the Invention

The invention relates to the field of footwear technology, in particular sports and leisure footwear, and concerns a sole for a running shoe.

Discussion of Related Art

A large number of running shoes with different cushioning systems are known in the prior art. Sports and leisure shoes with soles that have a gel core in the heel area to ensure vertical cushioning during footfall are widely used. Furthermore, improvements in vertical cushioning properties have been achieved by placing individual spring elements in the heel area between the outsole and insole.

While the above-mentioned soles improve the vertical cushioning properties of the shoes, they cannot achieve satisfactory cushioning of forces acting horizontally on the sole and shoe. Forces with a large horizontal component are particularly on deviating routes additionally increased and due to a lack of sufficient cushioning they represent one of the main causes of frequently occurring knee and hip joint pain.

A sole is known from WO 2016 184 920 of the applicant which has downwardly projecting, laterally open, segmented and channel-shaped elements. Under the effect of the forces occurring during running, the channel-shaped elements are deformable both vertically and horizontally until their lateral openings are closed. Segmentation of the sole also segments the cushioning effect, forming non-cushioned or less cushioned areas in the sole.

SUMMARY OF THE INVENTION

In many sports activities, such as running, the initial contact of the shoe with the ground occurs in the heel area. As a result, the forces acting on the shoe in this area are significantly greater than in the forefoot or midfoot area of the sole. To take this into account, running shoes generally have particularly pronounced cushioning in the heel area. Although such a design allows at least sufficient vertical cushioning to be provided, the pronounced cushioning has a negative effect on the overall weight of the shoe. As a result, running shoes known in the prior art have either an unsatisfactory cushioning effect and/or a high weight.

Furthermore, a satisfactory cushioning effect can be ensured with known cushioning systems, but due to the soft components, such as gel cores or soft-elastic foams, such cushioning systems lead to a loss of energy during the runner's rolling and push-off process. In this way, additional energy must be expended for the push-off with each step, which can lead to faster fatigue of the runner. This effect increases as the softness of the midsole increases. One problem of the state of the art is therefore to find a compromise between the softness of the midsole to increase the cushioning effect during the step and the stiffness of the midsole to avoid energy loss during the push-off.

It is therefore the general object of the invention to advance the prior art in the field of soles for running shoes and preferably to overcome one or more disadvantages of the prior art.

In some embodiments, a sole is provided which, on the one hand, achieves a satisfactory cushioning effect, particularly in the horizontal and vertical directions, and, at the same time, reduces energy losses during the push-off process and preferably provides additional energy for the push-off process.

In some embodiments, a sole is provided that has a low weight.

According to a first aspect of the invention, the general problem is solved by a sole for a running shoe having a midsole, wherein the midsole comprises a soft-elastic top layer and a soft-elastic bottom layer. In addition, a flexurally elastic incompressible plate is arranged in the vertical direction between the top layer and the bottom layer. The bottom layer comprises a plurality of channels extending in the transverse direction of the midsole, which are deformable vertically and/or horizontally in the longitudinal direction under the action of forces occurring during running, which act vertically and/or in the longitudinal direction. Preferably, the channels of the bottom layer of the midsole are under the action of forces acting vertically and/or in the longitudinal direction during running vertically and/or horizontally in the longitudinal direction deformable until closure.

The structure of the midsole is layered and, in some embodiments, can be described as a sandwich structure. Seen from the bottom side of the sole, or from the ground, the bottom layer is arranged first, followed by the flexurally elastic incompressible plate and then the top layer. The fact that the incompressible plate is thus arranged in the vertical direction between the top layer and the bottom layer allows, compared to an arrangement above the midsole that the plate in the sole can be bent more easily during the rolling process, respectively to have a lower bending moment, since the movement and the force emanating from the runner's foot are transmitted more efficiently through the top layer to the flexurally elastic incompressible plate. This effect is further enhanced by the channels, which make the midsole more flexible and easier to bend. Thus, the plate is tensioned during the rolling process and, due to its flexurally elastic incompressible properties, provides a restoring force that provides additional energy for the push-off process. At the same time, the channels arranged in the bottom layer enable an efficient and satisfactory cushioning effect.

Directional indications as used in the present disclosure are to be understood as follows: The longitudinal direction L of the sole is described by an axis from the heel area to the forefoot area, and thus extends along the longitudinal axis of the sole. The transverse direction Q of the sole extends transversely to the longitudinal axis and substantially parallel to the bottom side of the sole, or substantially parallel to the ground. Thus, the transverse direction runs along a transverse axis of the midsole. In the context of the present invention, the vertical direction V denotes a direction from the bottom side of the sole towards the insole, or in the operative state towards the foot of the wearer, and thus extends along a vertical axis of the midsole. The inner side of the midsole of a pair of running shoes designates the outer region of the midsole along the longitudinal axis, which faces the second running shoe in a pair of running shoes in the worn state. Accordingly, the outer side of the midsole of a pair of running shoes designates the outer region of the midsole along the longitudinal axis which, in the case of a pair of running shoes in the worn state, faces away from the second running shoe and is thus arranged opposite the inner side. Further, the lateral area of the midsole refers to a region along the lateral inner and outer sides of the midsole of the running shoe of a pair of running shoes, wherein the area extends in the direction of the longitudinal axis of the midsole. Typically, the horizontal extent of the lateral area is a few centimeters, for example 0.1 to 5 cm, preferably 0.5 to 3 cm. The medial area of the midsole refers to an area along the longitudinal axis at the center of the midsole, which extends in each case in the transverse direction of the midsole. Typically, The horizontal extent of the medial area is a few centimeters, for example 0.1 to 5 cm, preferably 0.5 to 3 cm.

Soft elastic materials for soles are commonly known to those skilled in the art. For example, materials having a Young's modulus of about 0.0001 to 0.2 GPa, and more particularly 0.001 to 0.1 GPa, may be used, which may be considered a soft elastic material for purposes of the present invention. Typically, such materials may comprise polymer foams. Soft elastic materials may include polyurethane, in particular thermoplastic polyurethane (TPU) or expanded thermoplastic polyurethane (eTPU), polyamides, e.g., PA-11, PA-12, nylon, polyethylene terephthalate (PET) or polybutylene terephthalate (PBT), or mixtures thereof.

The forces that occur during running are typically due to the weight force starting from the weight of the wearer, which can be, for example, between 40 and 120 kg, especially between 50 and 100 kg.

For the purposes of the present invention, a channel is to be understood as a recess which may typically be tubular in shape. Generally, a channel is wholly or partially delimited by channel walls. Typically, the channels are empty. In particular, the channels may be open and through-going, i.e., a channel is preferably not a blind hole. In preferred embodiments, the channels of the bottom layer may be substantially parallel to each other. In some embodiments, the total portion of the open area of the midsole, i.e., the total portion of the lateral areas of the channel openings, may be less than the total portion of the closed area of the midsole, i.e., the total portion of the outer area of the midsole that has no channels.

It is clear to the skilled person that the deformability of the channels may include, for example, the vertical merging of the channel walls and/or the shearing of the channel in the longitudinal direction. Typically, the upper and lower channel walls may contact each other under the effect of the forces occurring during running, so that the corresponding channel is deformed until it closes laterally. A channel wall may be formed by the soft-elastic top or bottom layer and/or by the flexurally elastic incompressible plate.

The flexurally elastic incompressible plate can be made of a rigid polymer, e.g., LDPE, HDPE, polypropylene, polyether block amide (PEBA, for example PEBAX®), etc., and/or carbon fibers or mixtures thereof. Preferably, the flexurally elastic incompressible plate is thus made of a different material than the top layer and the bottom layer. A flexurally elastic plate in the sense of the present invention can thereby have a Young's modulus of 5 to 20 GPa, in particular 10 to 15 GPa, preferably 13 to 15 GPa. The flexurally elastic incompressible plate may generally have a thickness, i.e., an extension in the vertical direction, of up to 5 mm, in particular 1 to 5 mm, preferably 1 to 3 mm.

In some embodiments, the thickness of the top layer in the vertical direction may be 0.3 to 2 cm.

In some embodiments, the top layer may have a plurality of channels extending in the transverse direction. On the one hand, these channels additionally improve the cushioning effect of the midsole, and on the other hand, the top layer becomes more flexible, making it easier to bend the flexurally elastic incompressible plate and thus facilitating the rolling-off process. In addition, the energy of the push-off is increased, since the restoring of the plate bent during the rolling process is improved during the push-off. In preferred embodiments, the channels of the top layer may extend substantially parallel to each other. Typically, the channels of the bottom layer and the top layer are configured such that during running as seen in the longitudinal direction, the channel of the bottom layer collapses first and only then the corresponding channel of the top layer. Typically, the channels of the top layer are deformable vertically and/or horizontally in the longitudinal direction under the action of forces acting vertically and/or longitudinally and occurring during running. Preferably, the channels of the top layer are deformable vertically and/or horizontally in the longitudinal direction under the effect of forces acting vertically and/or in the longitudinal direction and occurring during running until closure.

In further embodiments, the channels of the top layer can be arranged horizontally offset from the channels of the bottom layer in the longitudinal direction. This has the advantage that the cushioning can be arranged such that it is distributed over at least the entire midfoot area and heel area without having to dimension the channels excessively large, which would make the sole unstable. Due to the separation of the top layer and the bottom layer by the flexurally elastic incompressible plate, instabilities, in particular a floating effect, are also avoided.

In some embodiments, the channels of the top layer may be offset horizontally in the longitudinal direction relative to the channels of the bottom layer such that the channels of the top layer and the bottom layer do not overlap in the vertical direction. In such embodiments, therefore, preferably no channel is arranged in the top layer above a channel in the bottom layer and no channel is arranged in the bottom layer below a channel in the top layer, whereby the cushioning effect is additionally improved since the cushioning is not segmented and a cushioning effect is achieved in practically all relevant areas of the midsole. In addition, the flexibility of the midsole during the rolling motion is increased, since the channel walls in the top layer narrow during the rolling motion, or the channels are closed, thus facilitating the bending of the flexurally elastic incompressible plate.

Typically, at least part of, or all of, the channels of the top layer are deformable vertically and/or horizontally in the longitudinal direction until closure under the action of forces acting vertically and/or longitudinally and occurring during running.

In some embodiments, the channels of the top layer and/or the bottom layer have lateral openings in the lateral area of the midsole. Preferably, the channels are deformable vertically and/or horizontally in the longitudinal direction under the action of forces acting vertically and/or longitudinally and occurring during running until the lateral openings are closed.

In further embodiments, the channels in the top layer and/or the bottom layer are arranged at least in the heel area and the midfoot area. In some embodiments, the channels in the top layer and/or the bottom layer are arranged in the heel area, midfoot area, and forefoot area. In particular, the channels may be arranged longitudinally in the top layer and/or the bottom layer from the heel to the metatarsophalangeal joint of the wearer.

In some embodiments, the channels of the bottom layer are formed wholly or partially by transversely oriented channel-shaped elements projecting downwardly against the ground. In this case, only part of the channels of the bottom layer, in particular a large part, or even all of the channels of the bottom layer can be formed by channel-shaped elements. Such elements have the advantage that they are deformable and closable, particularly horizontally in the longitudinal direction, and thus provide good horizontal cushioning, which has a joint-protecting effect particularly on descending paths. The cross-section of the channel-shaped elements can be U-shaped. Preferably, the channel-shaped elements have a recess between them, which is configured to make the midsole more flexible and to facilitate the rolling motion by reducing the bending moment of the flexurally elastic incompressible plate in the sole. Preferably, the channel-shaped elements may thereby be arranged in such a way that at least one recess is arranged below a channel of the top layer, thereby facilitating the bending of the plate and thus the rolling motion. The recesses between the channel-shaped elements can define predetermined bending points of the midsole.

In some embodiments, the channels of the top layer are delimited by the soft elastic top layer and by the flexurally elastic incompressible plate. Additionally, or alternatively, the channels of the bottom layer are delimited by the soft-elastic bottom layer and by the flexurally elastic incompressible plate. Through this, the surface of the flexurally elastic incompressible plate is at least partially exposed, or is directly exposed to the environment and thus only partially directly covered by the top layer and/or the bottom layer. The channels, which are partially delimited by the plate, thus facilitate the bending of the plate during the rolling movement, since the compressive and tensile stresses on the plate are substantially reduced by the partial exposure of the plate due to the channels. On the one hand, this enables more efficient energy transfer during push-oil, and on the other hand, stiffer plates can be used than would be possible without such channels. Without such channels, relatively stiff plates would result in the plate not being able to bend readily during a normal running motion, which would significantly reduce running comfort. However, the use of stiffer plates has the advantage that the energy that can be provided for the push-off is correspondingly higher. In addition, such a structure allows for a smaller overall thickness of the midsole, which significantly reduces its weight. In particular, through the channels in the top layer, which are delimited by the flexurally elastic incompressible plate, 10 to 30%, in particular 20 to 30%, preferably 25 to 30% of the surface of the flexurally elastic incompressible plate can be exposed. In addition, or alternatively, (additional) 10 to 35%, in particular 20 to 35%, preferably 25 to 35% of the surface of the flexurally elastic incompressible plate may be exposed through the channels of the bottom layer. This significantly reduces the bending moment of the plate in the base and enables efficient energy transfer.

In further embodiments, the flexurally elastic incompressible plate extends substantially completely from the inner side to the outer side of the midsole. In such embodiments, the incompressible plate may be directly exposed to the environment on the inner side and/or the outer side and may thus be visible. The plate may thus completely separate the top layer and the bottom layer. Substantially completely is to be understood such that the plate extends over at least 90%, preferably at least 95%, preferably at least 98% of the area of the top layer.

In some embodiments, the channels of the bottom layer and/or the channels of the top layer are elongated in cross-section in the longitudinal direction of the midsole. Thus, the height of the channels (extension in the vertical direction) is smaller than the width of the channels (extension in the longitudinal direction), resulting in a smaller overall thickness of the midsole and thus a reduction in the weight of the sole.

In further embodiments, the midsole comprises a groove extending longitudinally from the heel area to at least the midfoot area. The groove is thus located in the medial area of the sole. On the one hand, the groove allows for a reduction in the weight of the sole, but on the other hand does not result in a significant reduction in the cushioning effect due to its medial position. In some embodiments, the channel may extend vertically directly to the flexurally elastic incompressible plate so that it may be partially, in the region of the groove, directly exposed to the environment and thus visible from the bottom side of the sole. Since no additional sole material is arranged in the area of the groove, the groove also facilitates the bending of the plate during running by reducing the bending moment of the plate in the sole, which makes the rolling process more comfortable and correspondingly increases the support during the push-off. The groove is particularly preferably substantially V-shaped, so that the lateral flanks of the groove are inclined. This prevents the entrapping of stones and pieces of wood. The channels in the transverse direction of the bottom layer can preferably be open towards the groove.

An embodiment in which the groove extends from the heel to the midfoot area has proven to be particularly advantageous. The groove allows better deformability of the channels, which is particularly advantageous with thicker wall thicknesses, as is preferably provided in the heel and midfoot area. In contrast, in the forefoot area a much weaker cushioning effect is typically required, which is why the channel walls in this area are thinner and thus more easily deformable than the channels in the heel and midfoot areas.

Preferably, the groove extends to the heel edge. This divides the soft-elastic midsole in two in the heel area. The two parts can move slightly away from each other in the transverse direction during landing, which additionally increases the cushioning effect.

In some embodiments, the channels of the bottom layer have a height in the vertical direction of from 0.1 to 2.0 cm, preferably from 0.2 to 1.0 cm, and the channels of the top layer have a height in the vertical direction of from 0.1 to 1.0 cm, preferably from 0.2 to 0.5 cm. The height hereby defines the distance between the respective channel walls in the vertical direction.

In further embodiments, the bottom layer is attached to the flexurally elastic incompressible plate. For example, the bottom layer may be bonded or welded thereto. The flexurally elastic incompressible plate may also be attached to the top layer by bonding or welding.

In some embodiments, at least one channel of the bottom layer, preferably all channels in the heel area and in the forefoot area, may have a front wall with an edge in the region of the flexurally elastic incompressible plate. The front wall typically refers to the wall of the channel that forms the front boundary of the channel in the longitudinal direction, i.e., in the running direction. Accordingly, the rear wall of the channel is the wall that forms the rear boundary of the channel in the longitudinal direction and is thus located closer to the heel edge of the running shoe. A step may be a first region of the front wall, which directly adjoins the flexurally elastic incompressible plate and has a greater slope than the adjoining second region of the front wall. For example, the first region can be formed essentially perpendicular to the flexurally elastic incompressible plate, e.g. at an angle of 80-90°. The adjoining second region of the front wall can form an angle of 35-60° to the flexurally elastic incompressible plate. A step in the front wall facilitates the horizontal shear and thus the closure of the channel to efficiently absorb horizontally acting forces.

In further embodiments, at least one channel of the bottom layer, preferably all channels in the heel area and in the midfoot area, may have a front wall and a rear wall, wherein the front wall is arranged at an angle to the flexurally elastic incompressible plate that is smaller than the angle at which the rear wall of the channel is arranged to the flexurally elastic incompressible plate. This facilitates the horizontal shear and thus the closure of the channel, which improves the cushioning of horizontally acting forces.

In some embodiments, the midsole is curved upward in the forefoot area in a vertical direction. In particular, the forefoot area may be curved upward at an angle of 25 to 35° in the vertical direction. Since the flexurally elastic incompressible plate is also bent upwards in the same way, the rolling movement is facilitated, i.e., the runner reaches the push-off position with less effort, in which only the forefoot area is in contact with the ground. This reduces the energy loss and fatigue of the runner.

In further embodiments, the heel area of the midsole can be raised vertically towards the heel edge. This can improve the runner's initial contact with the ground and support the rolling movement so that the runner requires less energy.

In further embodiments, the rearmost channel of the midsole in the longitudinal direction, i.e., the channel closest to the heel edge of the midsole, is arranged in such a way that it lies in the worn state directly below the wearer's heel. This ensures the greatest possible cushioning on initial contact with the ground. For example, the channel can be spaced 2 to 3.5 cm longitudinally from the heel edge, i.e., the rearmost edge of the midsole.

In some embodiments, the sole may include an outsole attached to the midsole, particularly directly to the bottom layer. In this regard, the outsole may have anti-slip properties. In particular, the outsole may be structured. The structuring may have regular or irregular grooves and/or furrows.

Preferably, the outsole can have cross structures. This ensures particularly good traction on the ground. Typically, the outsole is made of a different material than the midsole. In particular, the outsole can be made of an abrasion-resistant material, such as ITU, polypropylene, or another suitable material.

The outsole can preferably be provided on only a part of the midsole, so that part of the midsole has no outsole. In this context, it has proven to be particularly advantageous if a structured outsole is provided in the lateral area of the lateral outer side of the midsole, in particular in the heel area, midfoot area and forefoot area, since due to the anatomical conditions the landing and the push-off mainly take place in the lateral area on the lateral outer side. On the other hand, at least a part, preferably in the midfoot area, of the midsole in the lateral area on the lateral inner side of the midsole can have no outsole. This can result in significant time and cost savings in manufacturing without degrading the anti-slip properties of the sole. The forefoot area of the midsole typically also has an outsole.

In some embodiments, the structuring of the outsole is such that a structuring with sharper edges and/or a more pronounced structuring is provided in the lateral area of the lateral outer side than in the lateral area of the lateral inner side of the sole.

In some embodiments, the bottom layer and the top layer may not be directly connected to each other. Further, the top layer may be completely separated from the bottom layer by the flexurally elastic incompressible plate.

Typically, the top and bottom layers are manufactured separately and are therefore not one piece. In some embodiments, the midsole may comprise at least two separate sole components, the top layer and the bottom layer.

Another aspect of the invention relates to a running shoe comprising a sole according to any of the embodiments described herein.

Another aspect of the invention relates to the use of a sole according to one of the embodiments described herein for manufacturing a running shoe. For example, an upper may be attached to the sole according to the invention, in particular sewn and/or glued thereto.

BRIEF DESCRIPTION OF SEVERAL VIEWS OF THE DRAWINGS

Aspects of the invention are explained in more detail with reference to the embodiments shown in the following figures and the accompanying description.

DETAILED DESCRIPTION OF THE INVENTION

Figure 1:
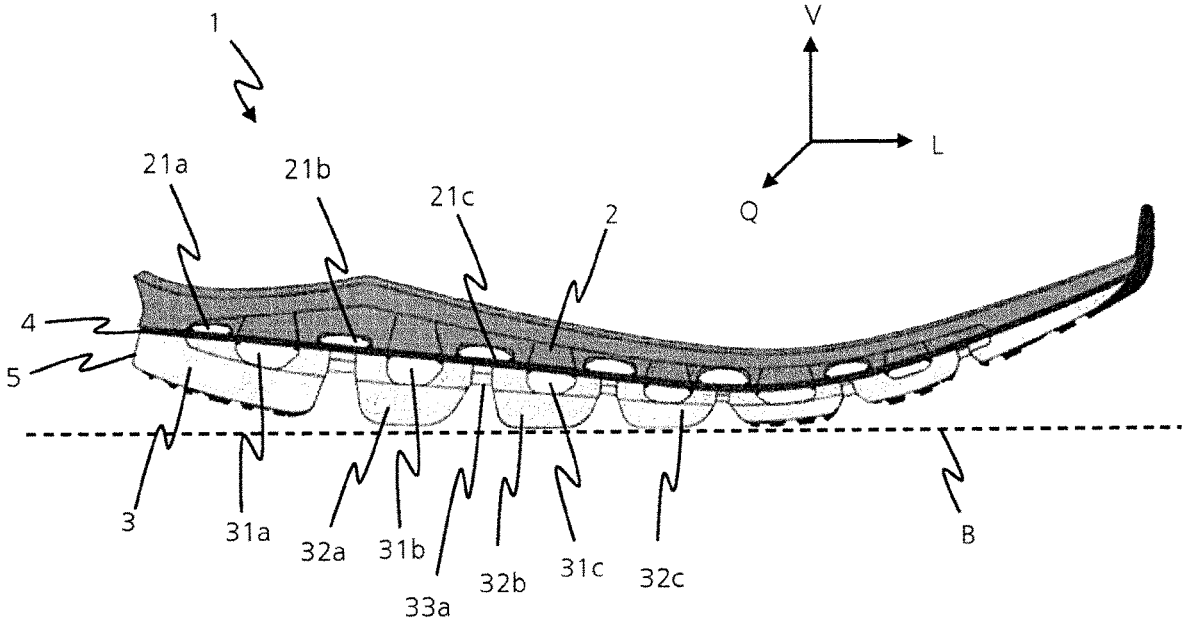
FIG. 1 shows a schematic side view of a sole for a running shoe according to one embodiment of the invention.

The embodiment of a sole for a running shoe shown in FIG. 1 comprises a midsole with a soft-elastic top layer 2 and a soft-elastic bottom layer 3. A flexurally elastic incompressible plate 4 is in the vertical direction V arranged between the 20 top layer 2 and the bottom layer 3. This results in a sandwich structure which, when viewed from the ground B, comprises the bottom layer 3 as the first layer, followed by the flexurally elastic incompressible plate 4 and finally the top layer 2. The flexurally elastic incompressible plate 4 thus generally forms an intermediate layer which is arranged between the top and bottom layer. The flexurally elastic incompressible plate 4 extends 5 substantially completely from the inner side to the outer side of the midsole and is also visible from the outside. As shown in FIG. 1, flexurally elastic incompressible plate 4 is visible and extends along a sidewall from a heel area, across a midfoot area, and through a forefoot area of the sole such that the plate continuously descends along the sidewall from the heel area to the midfoot area and continuously ascends from the midfoot area through the forefoot area. The plate thus separates the top layer 2 substantially completely from the bottom layer. The bottom layer 3 comprises a plurality of channels 31*a*, 31*b*, 31*c* (for the sake of clarity, the further channels are not designated) which extend in the transverse direction Q and which are deformable vertically (in the vertical direction V) 10 and/or horizontally in the longitudinal direction L under the action of forces acting vertically (in the vertical direction) and/or horizontally in the longitudinal direction L and occurring during running until closure. Furthermore, in this embodiment shown, the top layer 2 further comprises a plurality of channels 21*a*, 21*b*, 21*c* (for the sake of clarity, the further channels are not designated) extending in the transverse direction Q, at least some 15 of the channels of the top layer 2 being deformable vertically (in the vertical direction V) and/or horizontally in the longitudinal direction L under the action of forces acting vertically (in the vertical direction) and/or in the longitudinal direction L and occurring during running until closure. Furthermore, in this embodiment shown, the top layer 2 further comprises a plurality of channels 21*a*, 21*b*, 21*c* (for the sake of clarity, the further channels are not designated) extending in the transverse direction Q, at least some of the channels of the top layer 2 being deformable vertically (in the vertical direction V) and/or horizontally in the longitudinal direction L under the action of forces acting vertically (in the vertical direction) and/or in the longitudinal direction L and occurring during running until closure. As shown in FIG. 1, the channels 21*a*, 21*b*, 21*c* of the top layer 2 are arranged horizontally in the longitudinal direction L offset relative to the channels 31*a*, 31*b*, 31 *c* of the bottom layer 3, and in such a way that the channels of the top layer do not, in the vertical direction V, overlap with the channels of the bottom layer. In other words, no channel of the top layer lies in vertical direction V above a channel of the bottom layer. In the illustrated embodiment, the channels 31*b*, 31*c* of the bottom layer 3 are formed by channel-shaped elements 32*a* and 32*b*. In cross-section, the channel-shaped elements 32*a*, 32*b*, 32*c* are substantially U-shaped. In the channels 31*b* and 31*c*, the angle formed by the flexurally elastic incompressible plate 4 and the front wall of the respective channels is smaller than the angle formed by the flexurally elastic incompressible plate and the rear wall of the respective channels. The channel-shaped elements 32*a* and 32*b* have a recess 33*a* between them, which is configured to make the midsole more flexible for rolling movement. The recess 33*a* is thereby arranged in vertical direction V below the channel 21*c* of the top layer 2, which additionally facilitates the rolling movement and the bending of the flexurally elastic incompressible plate, since the recess 33*a* defines a predetermined bending point and the channel 21*c* closes, respectively can be closed, when the plate 4 is bent in vertical direction and/or in longitudinal direction. The channels of the top layer 2 and the bottom layer 3 in the embodiment shown in FIG. 1 are delimited by the flexurally elastic incompressible plate 4, thereby partially exposing the plate. The channels 21*a*, 21*b* and 21*c* of the top layer are delimited in the vertical direction at their respective bottom sides by the plate 4 and the channels 31*a*, 31*b* and 31*c* are delimited in the vertical direction at their respective top sides by the plate 4. Thus, in general, at least part of the channel wall of the channels of the top layer 2 and/or the channels of the bottom layer 3 is formed by the flexurally elastic incompressible plate 4. As shown in the side view of FIG. 1, both the channels 21*a*, 21*b* and 21*c* of the top layer 2 and the channels 31*a*, 31*b*, 31*c* of the bottom layer are elongated, i.e., the channel walls have a greater distance from each other in the longitudinal direction L than in the vertical direction V. The midsole 1 is bent upward at an angle of 25 to 35° relative to the ground B in the vertical direction V in the forefoot area. In addition, the heel portion of the midsole is raised in the vertical direction V. Channel 31*a*, which is the channel of the bottom layer 3 closest to the heel edge 5, is arranged such that it is located directly below the wearer's heel when worn.

Figure 2:
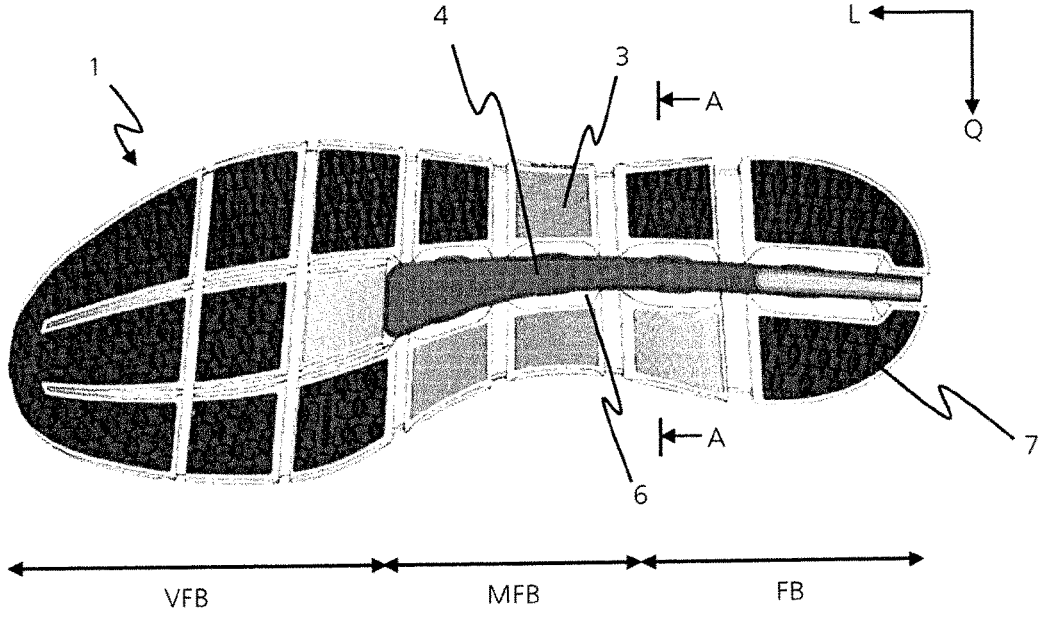
FIG. 2 shows a view of the bottom side of a sole according to the invention for a running shoe according to a further embodiment of the invention.

FIG. 2 shows the bottom side of a midsole 1 facing the ground in the worn state, with heel area FB, midfoot area MFB and forefoot area VFB. A groove 6, which is directed towards and open towards the ground, extends from the heel area FB into the midfoot area MFB. On a part of the midsole 1, respectively on the bottom layer 3, outsole 7 is arranged. It can be seen that no outsole is attached in the midfoot area of the midsole in the lateral area on the lateral inner side of the midsole. The outsole 7 has a structured design. In the embodiment shown, the structuring is designed as a cross structure. In this case, structuring with sharper edges and more pronounced structuring is provided in the lateral area of the lateral outer side than in the lateral area of the lateral inner side of the sole.

Figure 3:
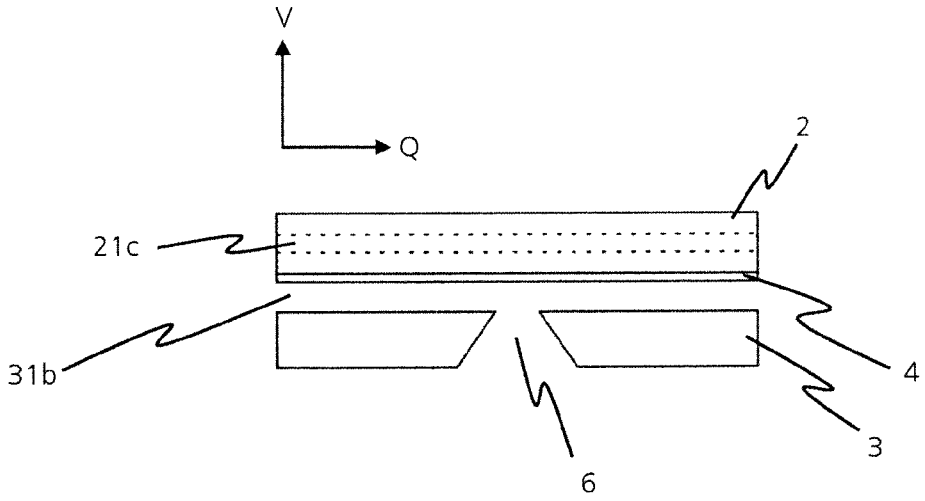
FIG. 3 shows a schematic section in the transverse direction (along AA according to FIG. 2) of a sole according to the invention for a running shoe according to a further embodiment of the invention.

FIG. 3 shows a cross-section in the transverse direction Q along the channel 31*b* extending in the transverse direction Q (see A-A in FIG. 2). The groove 6 is essentially V-shaped and the channel 31*b* in the bottom layer 3 is open towards the channel 6. The sandwich structure of bottom layer 3, flexurally elastic incompressible plate 4 and top layer 2 is also visible. The flexurally elastic incompressible plate 4 is arranged in the vertical direction V between the top layer and the bottom layer of the midsole 1. Dotted lines indicate the channel 21*c* of the top layer 2, which is not visible in the cross-section.

Figure 4:
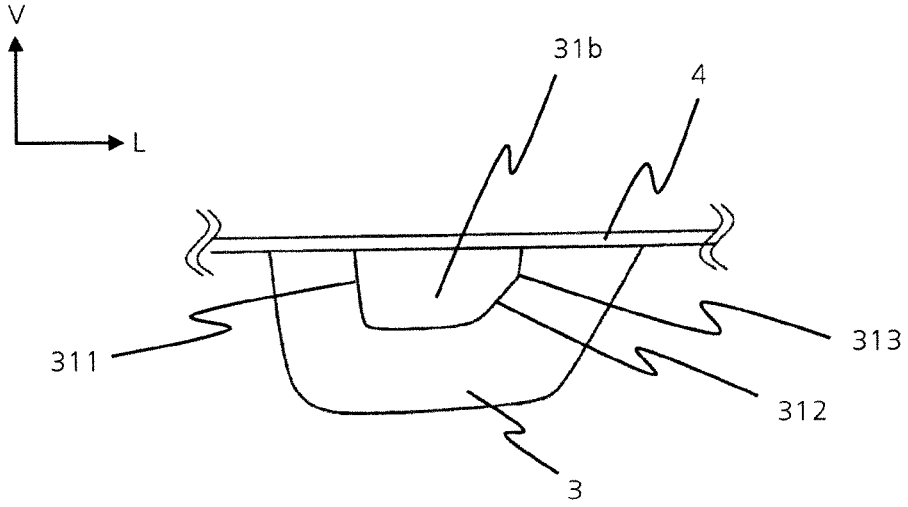
FIG. 4 shows a section of a channel of the sole shown in FIG. 1.

FIG. 4 shows an enlarged section of channel 31*b* of bottom layer 3. The channel 31*b* comprises a rear wall 311 and a front wall 312. The front wall 312 of the channel 31*b* comprises edge 313 that divides the front wall into first and second regions. The first region, which directly abuts the flexurally elastic incompressible plate 4, is substantially perpendicular to the plate 4. The second region of the front wall 312, which adjoins the first region at the edge 313, is arranged at a smaller angle to the flexurally elastic incompressible plate 4 than the first region.

The invention claimed is:

1. A sole for a running shoe having a midsole (1), the midsole (1) comprising:

a soft-elastic top layer (2) and a separate soft-elastic bottom layer (3), wherein a flexurally elastic incompressible plate (4) extending from an inner sidewall to an outer sidewall of the midsole (1) and exposed along at least one the inner sidewall and the outer sidewall from a heel area, across a midfoot area, and through a forefoot area of the sole such that the plate continuously descends along the at least one of the inner sidewall and outer sidewall from the heel area to the midfoot area and continuously ascends from the midfoot area through the forefoot area, the flexurally elastic incompressible plate (4) is in a vertical direction (V) arranged between and divides the top layer (2) and the separate bottom layer (3), and wherein the top layer (2) comprises a plurality of channels (21*a*, 21*b*, 21*c*) extending in a transverse direction (Q), and wherein the bottom layer (3) comprises a plurality of channels (31*a*, 31*b*, 31*c*) extending in the transverse direction (Q), wherein the channels of the top layer (2) are separated from the channels of the bottom layer by the flexurally elastic incompressible plate (4) and wherein the channels of the bottom layer (3) are delimited by the soft-elastic bottom layer (3) and by the flexurally elastic incompressible plate (4), wherein 10 to 35% of a surface of the flexurally elastic incompressible plate (4) is exposed by the channels in the bottom layer (3), and wherein the channels (31*a*, 31*b*, 31*c*) of the bottom layer (3) are deformable vertically (V) and/or horizontally in a longitudinal direction (L) under action of forces acting vertically (V) and/or in the longitudinal direction (L) and occurring during running.

2. The sole according to claim 1, wherein the channels (21*a*, 21*b*, 21*c*) of the top layer (2) are horizontally offset in the longitudinal direction (L) with respect to the channels (31*a*, 31*b*, 31*c*) of the bottom layer (3).

3. The sole according to claim 2, wherein the channels (21*a*, 21*b*, 21*c*) of the top layer (2) are arranged horizontally offset in the longitudinal direction (L) relative to the channels (31*a*, 31*b*, 31*c*) of the bottom layer (3) in such a way that the channels (21*a*, 21*b*, 21*c*, 31*a*, 31*b*, 31*c*) of the top layer (2) and the bottom layer (3) do not overlap in the vertical direction (V).

4. The sole according to claim 1, wherein the channels (21*a*, 21*b*, 21*c*) of the top layer (2) are deformable vertically (V) and/or horizontally in the longitudinal direction (L) until closure under the action of forces acting vertically (V) and/or in the longitudinal direction (L) occurring during running.

5. The sole according claim 1, wherein the channels (31*a*, 31*b*, 31*c*) of the bottom layer (3) are formed by channel-shaped elements (32*a*, 32*b*, 32*c*) oriented in the transverse direction (Q) and are configured to project downwardly toward the ground (B).

6. The sole according to claim 1, wherein the channels (21*a*, 21*b*, 21*c*) of the top layer (2) are delimited by the soft-elastic top layer (2) and by the flexurally elastic incompressible plate (4).

7. The sole according to claim 1, wherein the channels (31*a*, 31*b*, 31*c*) of the bottom layer (3) and/or the channels (21*a*, 21*b*, 21*c*) of the top layer (2) are elongated in cross-section in the longitudinal direction (L) of the middle sole (1).

8. The sole according to claim 1, wherein the channels (31*a*, 31*b*, 31*c*) of the bottom layer (3) have a height in the vertical direction (V) of 0.2 to 1.0 cm and the channels (21*a*, 21*b*, 21*c*) of the top layer (2) have a height in the vertical direction (V) of 0.2 to 0.5 cm.

9. The sole according to claim 1, wherein the bottom layer (3) is attached to the flexurally elastic incompressible plate (4).

10. The sole according to claim 9, wherein the bottom layer (3) is glued to the flexurally elastic incompressible plate (4).

11. The sole according to claim 1, wherein at least one channel of the plurality of channels of the bottom layer has a front wall with an edge in a region of the flexurally elastic incompressible plate.

12. The sole according to claim 1, wherein at least one channel of the plurality of channels of the bottom layer comprises an angle between a front wall of the at least one channel and the flexurally elastic incompressible plate that is less than the angle between a rear wall of the channel of the at least one channel and the flexurally elastic incompressible plate.

13. The running shoe comprising the sole according to claim 1.

14. A method of manufacture of the running shoe of claim 1 by attaching an upper to the sole.

15. The sole of claim 1, wherein the channels (31*a*, 31*b*, 31*c*) in the heel area include a thicker wall thickness than the channels (31*a*, 31*b*, 31*c*) in a forefoot area.

16. A sole for a running shoe having a midsole (1), the midsole (1) comprising:

a soft-elastic top layer (2) and a separate soft-elastic bottom layer (3), wherein a flexurally elastic incompressible plate (4) extending from an inner sidewall to an outer sidewall of the midsole (1) and exposed along at least one the inner sidewall and the outer sidewall from a heel area, across a midfoot area, and through a forefoot area of the sole such that the plate continuously descends along the at least one of the inner sidewall and outer sidewall from the heel area to the midfoot area and continuously ascends from the midfoot area through the forefoot area, the flexurally elastic incompressible plate (4) is in a vertical direction (V) arranged between and divides the top layer (2) and the separate bottom layer (3), and wherein the top layer (2) comprises a plurality of channels (21*a*, 21*b*, 21*c*) extending in a transverse direction (Q), and wherein the bottom layer (3) comprises a plurality of channels (31*a*, 31*b*, 31*c*) extending in the transverse direction (Q), wherein the channels of the top layer (2) are separated from the channels of the bottom layer by the flexurally elastic incompressible plate (4) and wherein the channels in the top layer (2) do not overlap in the vertical direction with the channels in the bottom layer (3), and wherein the channels of the bottom layer (3) are delimited by the soft-elastic bottom layer (3) and by the flexurally elastic incompressible plate (4), wherein channels in the top layer (2) and/or the bottom layer (3) extend in each of the heel area (FB), the midfoot area (MFB), and the forefoot area (VFB), wherein 10 to 35% of a surface of the flexurally elastic incompressible plate (4) is exposed by the channels in the bottom layer (3), and wherein the channels (31*a*, 31*b*, 31*c*) of the bottom layer (3) are deformable vertically (V) and/or horizontally in a longitudinal direction (L) under action of forces acting vertically (V) and/or in the longitudinal direction (L) and occurring during running.

* * * * *